US008522385B2

(12) United States Patent
Geurkink

(10) Patent No.: US 8,522,385 B2
(45) **Date of Patent: *Sep. 3, 2013**

(54) HIGH EFFICIENCY FLOOR TREATING SYSTEM AND METHOD

(76) Inventor: John Franklin Geurkink, Winchester, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,155

(22) Filed: May 22, 2012

(65) Prior Publication Data

US 2012/0227765 A1 Sep. 13, 2012

Related U.S. Application Data

(63) Continuation-in-part of application No. 12/815,523, filed on Jun. 15, 2010, now Pat. No. 8,356,375.

(60) Provisional application No. 61/490,620, filed on May 27, 2011.

(51) Int. Cl.
*A47L 11/12* (2006.01)

(52) U.S. Cl.
USPC ..... 15/49.1; 15/50.1; 15/98; 451/357; 451/353

(58) Field of Classification Search
USPC ..... 15/49.1, 50.1, 50.2, 52.2, 98, 180; 451/350, 353, 357, 360, 359
See application file for complete search history.

(56) References Cited

U.S. PATENT DOCUMENTS

| | | | | | |
|---|---|---|---|---|---|
| 2,626,412 | A * | 1/1953 | Petersen | 15/50.1 |
| 2,832,978 | A * | 5/1958 | Mann et al. | 15/50.1 |
| 3,348,254 | A | 10/1967 | Storm et al. | |
| 3,416,177 | A | 12/1968 | Young | |
| 3,482,362 | A * | 12/1969 | Bangerter et al. | 451/357 |
| 4,610,111 | A * | 9/1986 | Cox | 451/357 |
| 4,791,694 | A * | 12/1988 | Itaya et al. | 15/97.1 |
| 5,355,542 | A | 10/1994 | Oreck et al. | |
| 5,947,804 | A * | 9/1999 | Fukinuki et al. | 451/357 |
| 6,238,277 | B1 * | 5/2001 | Duncan et al. | 451/271 |
| 6,938,295 | B1 * | 9/2005 | Lancaster et al. | 15/49.1 |
| 8,356,375 | B2 * | 1/2013 | Geurkink | 15/50.1 |
| 2006/0150362 | A1 | 7/2006 | Mitchell | |

* cited by examiner

*Primary Examiner* — Mark Spisich
*Assistant Examiner* — Andrew A Horton
(74) *Attorney, Agent, or Firm* — Stoll Keenon Ogden, PLLC; Rebecca Ann Krefft

(57) ABSTRACT

A system and method for high efficiency floor treating is provided. Embodiments of the floor treating system include a floor treating device with a power source having a rotatable drive shaft with an axis of rotation, a flywheel with an aperture for receiving the drive shaft, a counterbalance connected to the flywheel, and a floor treating attachment located at a distance of at least 0.400 inch from the axis of rotation of the drive shaft. Embodiments of the floor treating method include agitating a cleaning substance using the floor treating device with the floor treating attachment positioned at least 0.400 inch from the axis of rotation of the drive shaft.

20 Claims, 5 Drawing Sheets

HIGH EFFICIENCY FLOOR TREATING SYSTEM AND METHOD

CROSS-REFERENCE TO RELATED APPLICATIONS

This application claims priority as a continuation-in-part application of U.S. patent application Ser. No. 12/815,523, entitled "Floor Treating System and Method" and filed on Jun. 15, 2010, now U.S. Pat. No. 8,356,375 and claims priority to U.S. Provisional Application No. 61/490,620, entitled "HE (High Efficiency) Orbital" and filed on May 27, 2011, each of which is incorporated by reference herein in its entirety.

MULTIPLE EMBODIMENTS AND ALTERNATIVES

Figure 1:
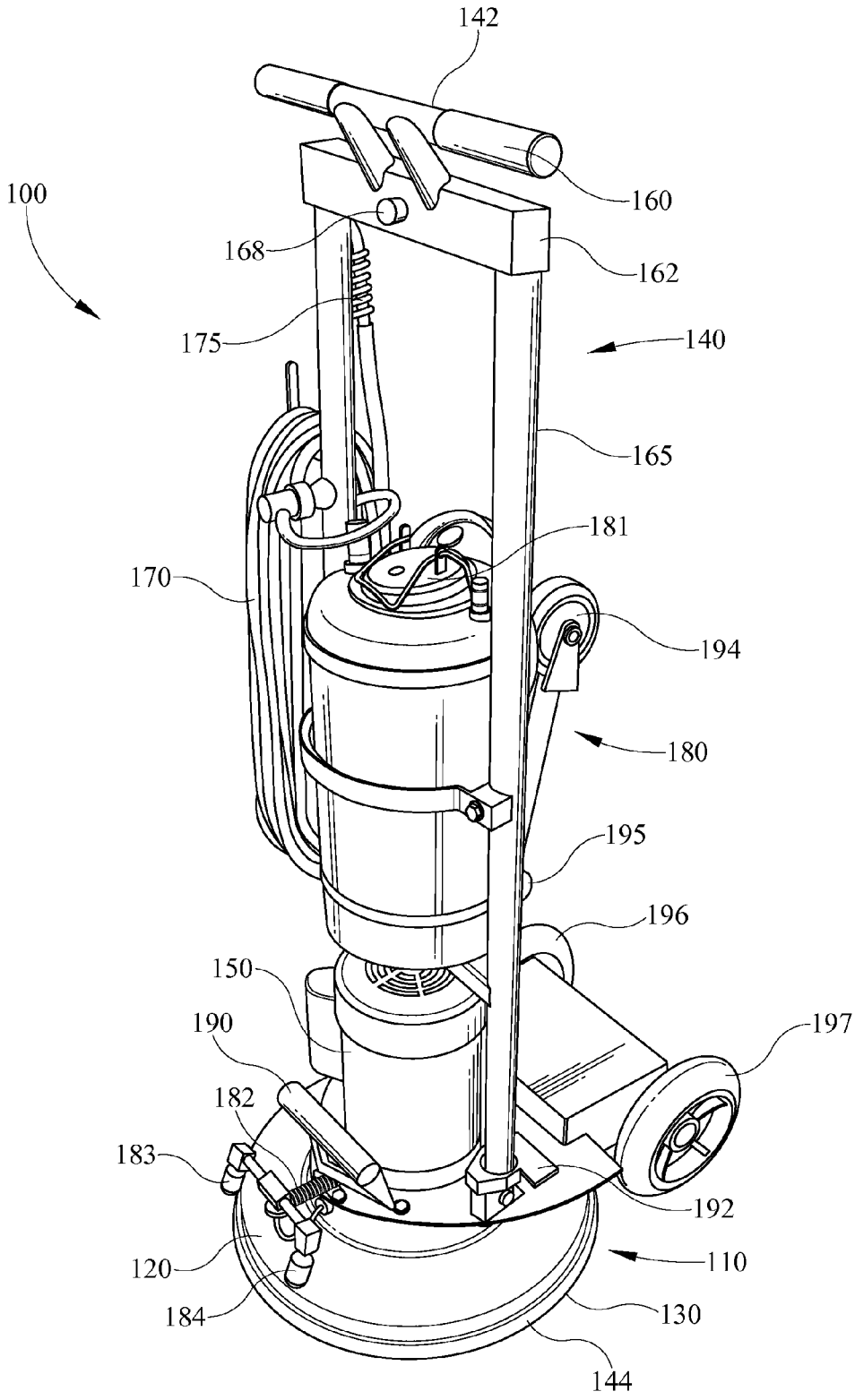
FIG. 1 is a perspective view of a floor treating system according to multiple embodiments and alternatives.
Figure 2:
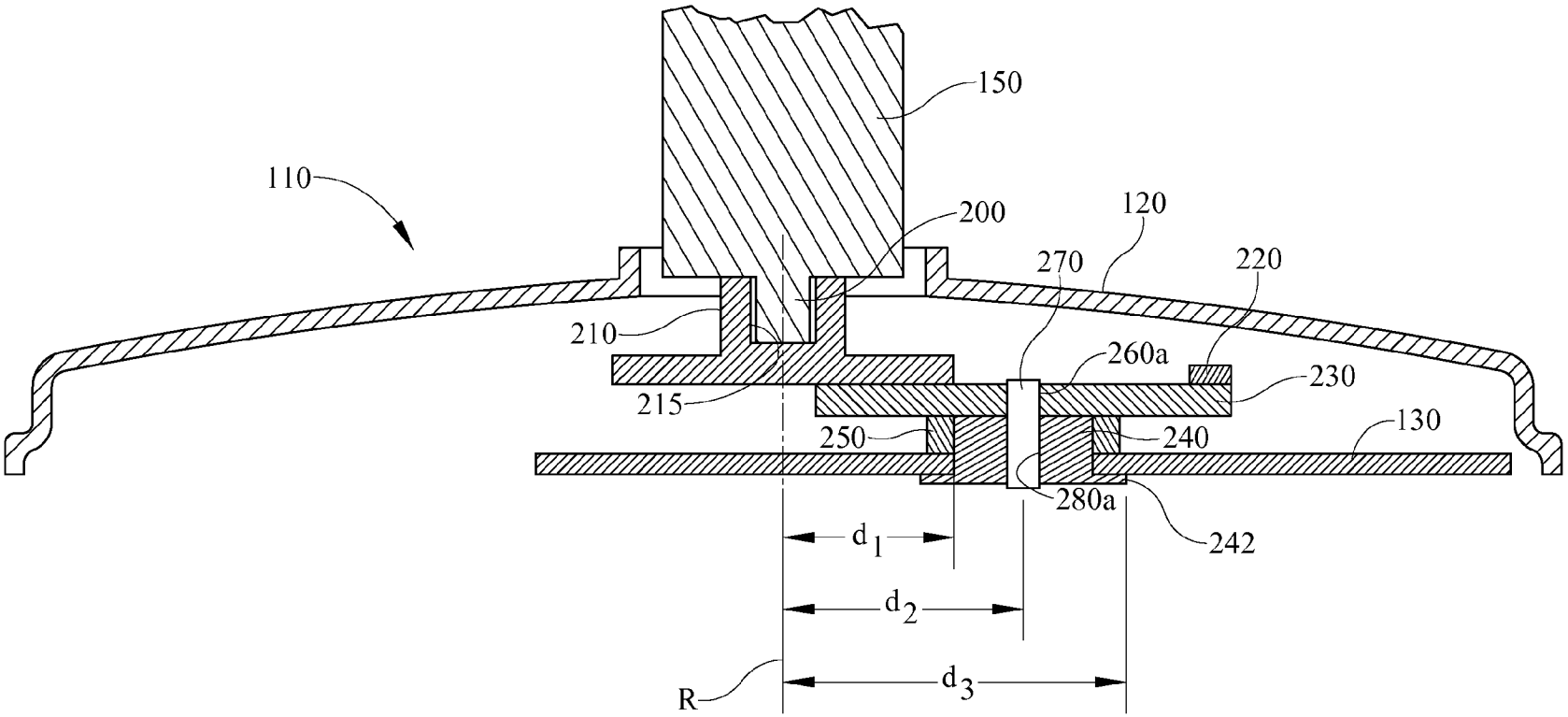
FIG. 2 is a cutaway side view of a bottom portion of a floor treating system with a floor treating attachment according to multiple embodiments and alternatives.

Turning now to the drawings and, more particularly to FIG. 1, a floor treating system according to multiple embodiments and alternatives is illustrated generally at 100 and includes a bottom portion 110. An embodiment of the bottom portion 110 of the floor treating system 100 is further illustrated in FIG. 2. As shown in FIG. 2, the bottom portion 110 includes a power source 150 with a rotatable drive shaft 200, a floor treating attachment 130, and means for imparting at least two speeds of oscillating motion from the drive shaft 200 to the floor treating attachment 130. The floor treating attachment 130 may be any of a number of conventional floor treating attachments commonly utilized in floor treating systems, such as a carpet cleaning attachment, a tile cleaning brush, a hardwood sanding attachment, a vinyl composition tile (VCT) stripping attachment, or a stone, marble, or terrazzo grinding, sanding, honing, or polishing attachment, for example. In some embodiments, the floor treating attachment 130 may be a rug beating attachment. The power source 150 may be any of a number of conventional power sources commonly utilized in floor treating systems, such as a motor, for example.

Returning to FIG. 1, multiple embodiments of the floor treating system 100 include a housing assembly 140 with a proximal end 142 and a distal end 144. The housing assembly 140 may be manufactured from conventional materials commonly utilized in floor treating system housings including, but not limited to, anodized aluminum, stainless steel, and nickel. The floor treating system 100 may also include a brush cover 120, and the brush cover 120 may be manufactured from conventional materials commonly utilized in floor treating system brush covers including, but not limited to, anodized aluminum, stainless steel, and nickel. The floor treating system 100 may further include a handle assembly 165 with a handle 160 and a handle plate 162. Any electrical wiring may be enclosed in the handle assembly 165 and behind the handle plate 162. Additionally, the floor treating system 100 may include an on and off switch 168, an electrical cord 170, a strain relief 175 on the electrical cord 170, a lifting handle 190, a kickstand 192, and wheels 194, 196, and 197. The wheel 194 may be adjustably mounted onto the housing assembly 140 with an adjustable knuckle 195, which may adjusted in increments of ten degrees, for example.

Multiple embodiments of the floor treating system 100 include a spray system 180, which may include a spray tank 181, a spring 182, and spray heads 183 and 184. The spray tank 181 may be mounted on the housing assembly 140 and may be manufactured from a material resistant to corrosion, such as stainless steel or titanium, for example. The spray heads 183 and 184 may be mounted on the housing assembly 140 with the spring 182, thereby reducing damage to the spray heads 183 and 184 and to walls, and may be manufactured from a non-marring material, such as a polymer, for example, thereby reducing marring to walls from the spray heads 183 and 184. Also, the wheel 194 may be configured to bear the load of the spray tank 181 and to facilitate maneuvering of the floor treating system 100. The spray system 180 may also include a pump (not shown) and hose assembly (not shown), which may be substantially enclosed in the housing assembly 140. Additionally, the pump may be located between the spray heads 183 and 184 and the distal end 144 of the housing assembly, thereby reducing any leakage of fluid from the spray heads 183 and 184. The pump may also be located between the spray tank 181 and the distal end 144 of the housing assembly the spray tank 181. Also, the spray tank 181 may be sealed, thereby further reducing any leakage of fluid from it.

As illustrated in FIG. 2, in multiple embodiments of the bottom portion 110, the rotatable drive shaft 200 of the power source 150 rotates around an axis of rotation R. In some embodiments, the means for imparting at least two speeds of oscillating motion from the drive shaft 200 to the floor treating attachment 130 comprise a flywheel 210 having an aperture 215 to receive the drive shaft 200, a counterbalance 230 configured to connect to the flywheel 210, and means for connecting the floor treating attachment 130 to the counterbalance 230 at at least two different distances from the axis of rotation R. For example, the means for connecting the floor treating attachment 130 to the counterbalance 230 may be configured to connect the floor treating attachment 130 to the counterbalance 230 at a distance $d_1$ from the axis of rotation R, at a distance $d_2$ from the axis of rotation R, and at a distance $d_3$ from the axis of rotation R. Each distance from the axis of rotation R corresponds to a different speed of oscillating motion that may be imparted from the drive shaft 200 to the floor treating attachment 130. In multiple embodiments, the drive shaft 200 of the power source 150 rotates the flywheel 210 around the axis of rotation R, the rotation of the flywheel 210 provides motion to the counterbalance 230, and the motion of the counterbalance 230 imparts an oscillating motion to the floor treating attachment 130 through the means for connecting the floor treating attachment 130 to the counterbalance 230.

Figure 7:
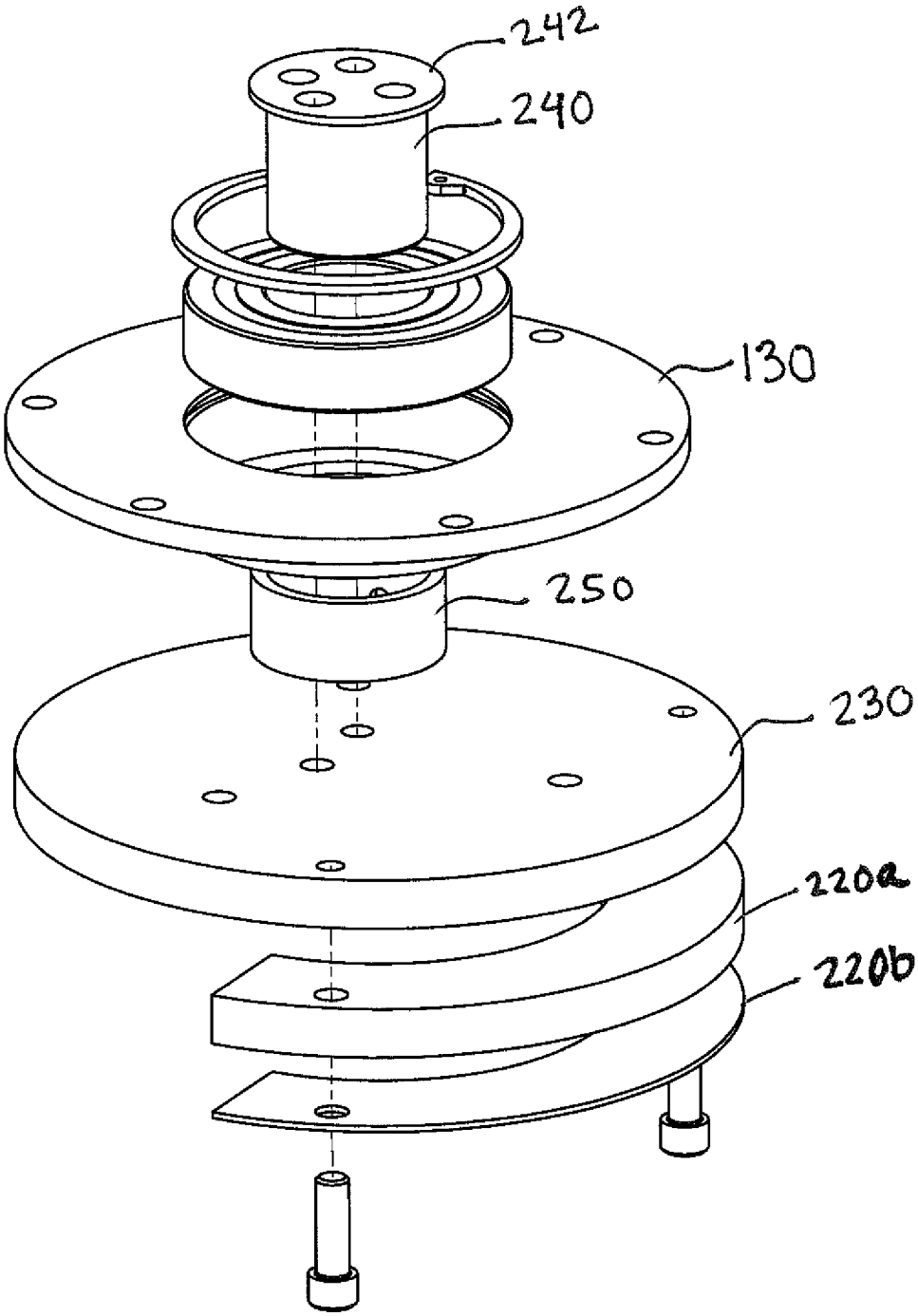
FIG. 7 is an exploded perspective view of a floor treating attachment and a counterbalance according to multiple embodiments and alternatives.

In some embodiments, the bottom portion 110 also includes a counterweight 220, or a number of counterweights 220*a* and 220*b* (as shown in FIG. 7), configured to attach to the counterbalance 230. Additionally, the means for connecting the floor treating attachment 130 to the counterbalance

230 may comprise a plug bearing 240, a spacer 250, and a bolt 270, in some embodiments. The plug bearing 240 may have a lip 242 that extends over part of the floor treating attachment 130 to assist in connecting the floor treating attachment 130 to the counterbalance 230, while the remainder of the plug bearing 240 is positioned between the floor treating attachment 130 and the counterbalance 230. In multiple embodiments, the drive shaft 200 of the power source 150 rotates the flywheel 210 around the axis of rotation R, the rotation of the flywheel 210 provides motion to the counterbalance 230, and the motion of the counterbalance 230 imparts an oscillating motion to the floor treating attachment 130 through the plug bearing 240.

Figure 3:
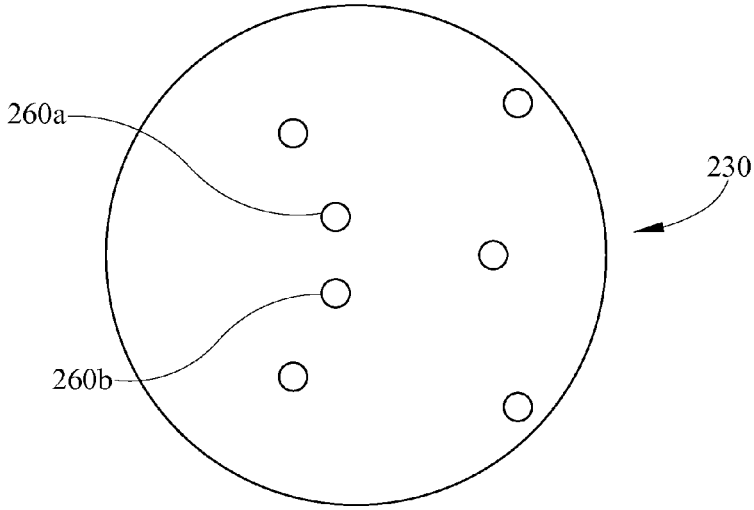
FIG. 3 is a top plan view of a counterbalance according to multiple embodiments and alternatives.
Figure 4:
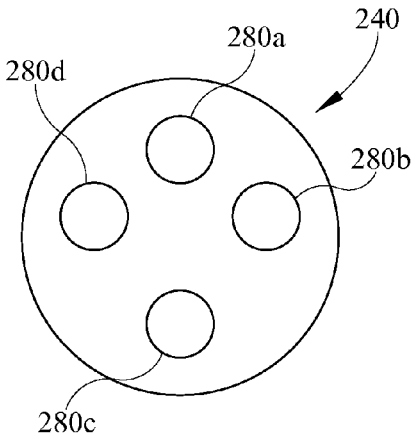
FIG. 4 is a top plan view of a plug bearing according to multiple embodiments and alternatives.
Figure 5:
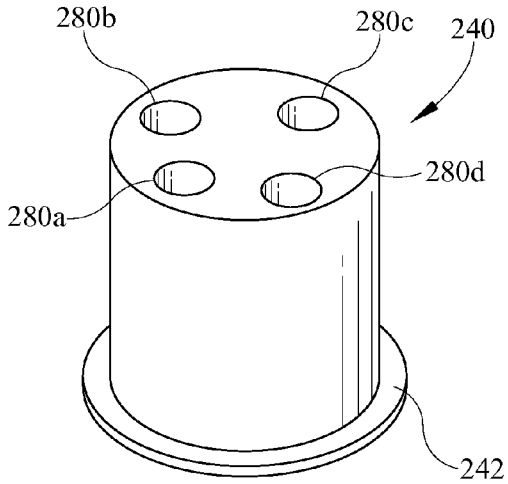
FIG. 5 is a perspective view of a plug bearing according to multiple embodiments and alternatives.

As illustrated in FIG. 3, the counterbalance 230 may include apertures 260*a* and 260*b*, and, as illustrated in FIGS. 4 and 5, the plug bearing 240 may include apertures 280*a*-280*d*. Any of the plug bearing apertures 280*a*-280*d*, or any combination of the plug bearing apertures 280*a*-280*d*, may be configured to align with any of the counterbalance apertures 260*a* and 260*b*, or any combination of the counterbalance apertures 260*a* and 260*b*, each alignment corresponding to a different distance from the axis of rotation R to the floor treating attachment 130. Each distance from the axis of rotation R, in turn, corresponds to a different speed of oscillating motion that may be imparted from the drive shaft 200 to the floor treating attachment 130. Also, the bolt 270 may extend through any of the plug bearing apertures 280*a*-280*d* and any of the counterbalance apertures 260*a* and 260*b* to assist with the connection of the floor treating attachment 130 to the counterbalance 230.

As shown in FIG. 2, for example, the plug bearing aperture 280*a* may align with the counterbalance aperture 260*a*, with the bolt 270 extending through the apertures 280*a* and 260*a*. This alignment may correspond to the distance $d_2$ from the axis of rotation R and to a speed of oscillating motion that is imparted from the drive shaft 200 to the floor treating attachment 130. The plug bearing aperture 280*c* may also be configured to align with the counterbalance aperture 260*a*, with the bolt 270 extending through the apertures 280*c* and 260*a*. This alignment may correspond to a different distance from the axis of rotation R and to a different speed of oscillating motion that is imparted from the drive shaft 200 to the floor treating attachment 130. Thus, different speeds of oscillating motion may be utilized during different applications of the floor treating system 100, such as a higher speed when cleaning a floor quickly is desirable and a lower speed when cleaning a floor with less power is desirable, for example.

Returning to FIG. 1, in multiple embodiments of the floor treating system 100, the floor treating attachment 130 may be located at a distance of at least 0.400 inch from the axis of rotation of the rotatable drive shaft of the power source 150. In some embodiments of the bottom portion 110 shown in FIG. 2, for example, the distance $d_2$ may be approximately 0.4375 inch from the axis of rotation R and the counterweight 220 may have a mass between 1946 grams and 1956 grams. In certain embodiments, the distance $d_1$ may be approximately 0.375 inch and the distance $d_3$ may be approximately 0.5625 inch, with the counterweight 220 having a mass between 1946 grams and 1956 grams.

Each distance from the axis of rotation of the rotatable drive shaft corresponds to a different size of orbit of the floor treating attachment 130. For example, in some embodiments, the floor treating attachment 130 may have a diameter of 15 inches and may be 0.375 inch from the axis of rotation, corresponding to an orbit size of 15.75 inches. In other embodiments, the floor treating attachment 130 may have a diameter of 15 inches and may be 0.4375 inch from the axis of rotation, for example, corresponding to an orbit size of 15.875 inches.

Each orbit size corresponds to a different speed of oscillating motion imparted from the drive shaft at a given number of revolutions per minute, and to a different amount of power required to impart that speed of motion. For example, in some embodiments, the floor treating attachment 130 may be 0.25 inch from the axis of rotation of the rotatable drive shaft, corresponding to a ⅓ horsepower requirement to impart oscillating motion at 1725 revolutions per minute. In other embodiments, the floor treating attachment 130 may be 0.375 inch from the axis of rotation, corresponding to a 0.5 horsepower requirement to impart oscillating motion at 1725 revolutions per minute. In other embodiments, the floor treating attachment 130 may be 0.4375 inch from the axis of rotation, corresponding to a 0.75 horsepower requirement to impart oscillating motion at 1725 revolutions per minute. In other embodiments, the floor treating attachment 130 may be 0.5 inch from the axis of rotation, corresponding to a 1 horsepower requirement to impart oscillating motion at 1725 revolutions per minute.

Returning to FIG. 1, in some embodiments of the floor treating system 100, a cleaning substance is placed on a floor, the floor treating attachment 130 is placed over the cleaning substance, the cleaning substance is allowed time to dry and crystallize, and the cleaning substance is removed from the floor. The cleaning substance may be any of a number of substances, including, but not limited to, polymer-based cleaning substances, emulsification cleaning substances, and encapsulation cleaning substances. In certain embodiments, the spray system 180 may be utilized to spray the cleaning substance over the floor. In such embodiments, the pump and hose assembly may be used to spray the substance from the spray tank 181 through the spray heads 183 and 184. In some embodiments, the floor treating attachment 130 also provides agitation to the cleaning substance and the floor after the substance is placed on the floor.

An increased distance of the floor treating attachment 130 from the axis of rotation of the rotatable drive shaft, and corresponding increased orbit size and increased speed of oscillating motion, improve efficiency in floor treating. For example, in some embodiments, the floor treating attachment 130 is at least 0.400 inches from the axis of rotation, thereby increasing the agitation provided to the cleaning substance and floor. In such embodiments, the increase in agitation may produce a mixture of moisture, cleaning substance, and soil from the floor, and the mixture may dry, encapsulating the soil. In certain embodiments, the mixture may be easily removed from the floor, for example, with a vacuum. In addition, in providing agitation to a carpet, for example, an increased orbit size of the floor treating attachment 130 is easier on the carpet fibers compared to smaller orbit sizes, thereby preserving the carpet and decreasing the wear on it.

Figure 6:
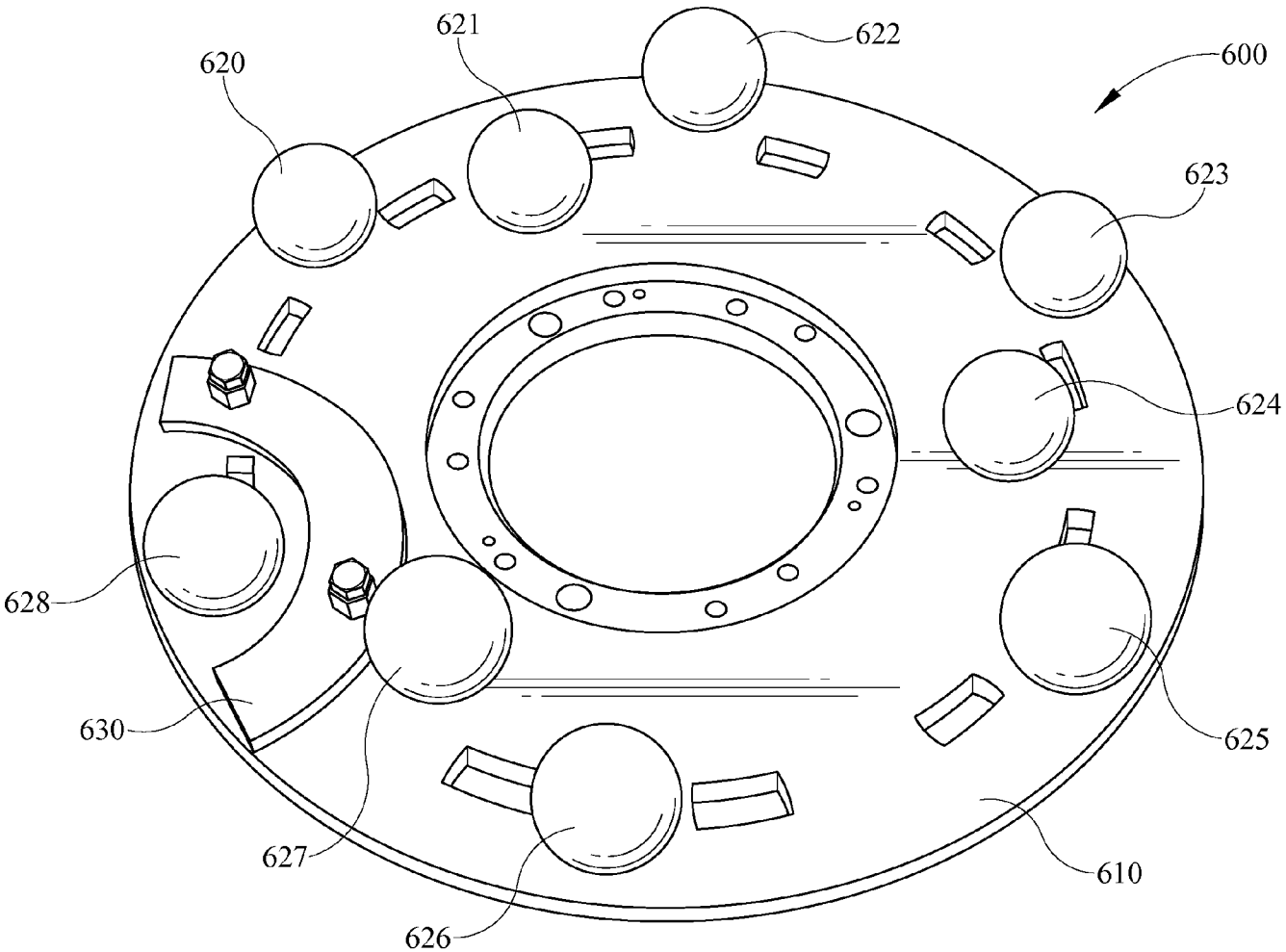
FIG. 6 is a perspective view of a rug beating attachment according to multiple embodiments and alternatives.

Turning to FIG. 6, multiple embodiments of the floor treating system include a rug beating attachment 600 and means for imparting a vibrating motion from the drive shaft to the rug beating attachment 600, in addition to the floor treating attachment and means for imparting an oscillating motion from the drive shaft to the floor treating attachment. The rug beating attachment 600 may be utilized to beat dirt, dust, and other particles from a rug that is placed over a perforated mat or grate, for example.

Also, in multiple embodiments of the bottom portion 110 (shown in FIGS. 1& 2) of the floor treating system 100, the rug beating attachment 600 takes the place of the floor treating attachment 130. In some embodiments, the means for imparting a vibrating motion from the drive shaft 200 to the rug beating attachment 600 comprise the flywheel 210, the counterbalance 230, and a counterweight 630 configured to attach to the rug beating attachment 600. The counterbalance 230 may connect to the flywheel 210 and the rug beating attachment 600, the counterweight 630 counteracting any reduction in vibrations from the counterbalance 230 and thereby increasing vibrations. In multiple embodiments, the drive shaft 200 of the power source 150 rotates the flywheel 210 around the axis of rotation R, the rotation of the flywheel 210 provides motion to the counterbalance 230, and the counterbalance 230 and the counterweight 630 impart a vibrating motion to the rug beating attachment 600.

In some embodiments, the plug bearing lip 242 extends over part of the rug beating attachment 600 to assist with the connection of the rug beating attachment 600 to the counterbalance 230, while the remainder of the plug bearing 240 is positioned between the rug beating attachment 600 and the counterbalance 230. Any of the plug bearing apertures 280*a*-280*d*, or any combination of the plug bearing apertures 280*a*-280*d*, may be configured to align with any of the counterbalance apertures 260*a* and 260*b*, or any combination of the counterbalance apertures 260*a* and 260*b*, each alignment corresponding to a different distance from the axis of rotation R to the rug beating attachment 600. Also, the bolt 270 may extend through any of the plug bearing apertures 280*a*-280*d* and any of the counterbalance apertures 260*a* and 260*b* to assist with the connection of the rug beating attachment 600 to the counterbalance 230.

In multiple embodiments, the rug beating attachment 600 may be positioned at a distance of at least 0.400 inch from the axis of rotation of the rotatable drive shaft of the power source 150. In some embodiments of the bottom portion 110 (shown in FIGS. 1 & 2), for example, the distance $d_2$ may be approximately 0.4375 inch from the axis of rotation R and the counterweight 220 may have a mass between 1946 grams and 1956 grams. In certain embodiments, the distance $d_1$ may be approximately 0.375 inch and the distance $d_3$ may be approximately 0.5625 inch, with the counterweight 220 having a mass between 1946 grams and 1956 grams.

Each distance from the axis of rotation of the rotatable drive shaft corresponds to a different size of orbit of the rug beating attachment 600. For example, in some embodiments, the rug beating attachment 600 may have a diameter of 15 inches and may be 0.375 inch from the axis of rotation, corresponding to an orbit size of 15.75 inches. In other embodiments, the rug beating attachment 600 may have a diameter of 15 inches and may be 0.4375 inch from the axis of rotation, for example, corresponding to an orbit size is 15.875 inches.

Each orbit size corresponds to a different speed of motion imparted from the drive shaft at a given number of revolutions per minute, and to a different amount of power required to impart that speed of motion. For example, in some embodiments, the rug beating attachment 600 may be 0.25 inch from the axis of rotation of the rotatable drive shaft, corresponding to a ⅓ horsepower requirement to impart motion at 1725 revolutions per minute. In other embodiments, the rug beating attachment 600 may be 0.375 inch from the axis of rotation, corresponding to a 0.5 horsepower requirement to impart motion at 1725 revolutions per minute. In other embodiments, the rug beating attachment 600 may be 0.4375 inch from the axis of rotation, corresponding to a 0.75 horsepower requirement to impart motion at 1725 revolutions per minute. In other embodiments, the rug beating attachment 600 may be 0.5 inch from the axis of rotation, corresponding to a 1 horsepower requirement to impart motion at 1725 revolutions per minute.

Additionally, in some embodiments, the rug beating attachment 600 includes a plate 610 and spheres 620-628 configured to attach to the plate 610. The plate 610 may be manufactured from any of a number of materials, including, but not limited to, polymers. The spheres 620-628 may be manufactured from any of a number of materials, including, but not limited to, phenolic resins, and may attach to the plate 610 with bolts, for example.

It will therefore be readily understood by those persons skilled in the art that the embodiments and alternatives of a floor treating system 100 and method are susceptible to a broad utility and application. While the embodiments are described in all currently foreseeable alternatives, there may be other, unforeseeable embodiments and alternatives, as well as variations, modifications and equivalent arrangements that do not depart from the substance or scope of the embodiments. The foregoing disclosure is not intended to be construed to limit the embodiments or otherwise to exclude such other embodiments, adaptations, variations, modifications and equivalent arrangements, the embodiments being limited only by the claims appended hereto and the equivalents thereof.

What is claimed is:

1. An oscillating, floor treating device comprising:

a power source having a rotatable drive shaft, wherein the rotatable drive shaft rotates around an axis of rotation;

a flywheel having an aperture configured to receive the drive shaft;

a counterbalance connected to and extending radially from the flywheel; and a floor treating attachment configured to connect to the counterbalance at at least two different distances from the axis of rotation of the drive shaft, a first distance being at least 0.400 inch from the axis of rotation of the drive shaft.

2. The oscillating, floor treating device of claim 1, wherein the first distance is about 0.4375 inch from the axis of rotation of the drive shaft.

3. The oscillating, floor treating device of claim 1, wherein the first distance is about 0.5625 inch from the axis of rotation of the drive shaft.

4. The oscillating, floor treating device of claim 1, further comprising at least one weight attached to the counterbalance.

5. An oscillating, floor treating device comprising:

a power source having a rotatable drive shaft, wherein the rotatable drive shaft rotates around an axis of rotation;

a flywheel having an aperture configured to receive the drive shaft;

a counterbalance connected to the flywheel;

a floor treating attachment configured to connect to the counterbalance at at least two different distances from the axis of rotation of the drive shaft, a first distance being at least 0.400 inch from the axis of rotation of the drive shaft; and a plug bearing configured to be positioned between a bottom of the counterbalance and a top of the floor treating attachment.

6. The oscillating, floor treating device of claim 5, wherein the first distance is about 0.4375 inch from the axis of rotation of the drive shaft.

7. The oscillating, floor treating device of claim 5, wherein the first distance is about 0.5625 inch from the axis of rotation of the drive shaft.

8. The oscillating, floor treating device of claim 5, further comprising at least one weight attached to the counterbalance.

9. The oscillating, floor treating device of claim 5, wherein the counterbalance has an aperture and the plug bearing has at least two different apertures configured to align with the counterbalance aperture.

10. An oscillating, floor treating device comprising:

a power source having a rotatable drive shaft, wherein the rotatable drive shaft rotates around an axis of rotation;

a flywheel having an aperture configured to receive the drive shaft;

a counterbalance connected to the flywheel; and a floor treating attachment configured to connect to the counterbalance at a first distance of at least 0.400 inch from the axis of rotation of the drive shaft, wherein the counterbalance is radially spaced from the axis of the drive shaft.

11. The oscillating, floor treating device of claim 10, wherein the first distance is about 0.4375 inch from the axis of rotation of the drive shaft.

12. The oscillating, floor treating device of claim 10, wherein the first distance is about 0.5625 inch from the axis of rotation of the drive shaft.

13. The oscillating, floor treating device of claim 10, further comprising at least one weight attached to the counterbalance.

14. The oscillating, floor treating device of claim 13, wherein the weight has a mass between about 1946 grams and about 1956 grams.

15. The oscillating, floor treating device of claim 10, wherein the floor treating attachment is selected from the group consisting of: a carpet cleaning attachment, a tile cleaning brush, a hardwood sanding attachment, a vinyl composition tile stripping attachment, a stone grinding attachment, a stone sanding attachment, a stone honing attachment, a stone polishing attachment, a terrazzo grinding attachment, a terrazzo sanding attachment, a terrazzo honing attachment, and a terrazzo polishing attachment.

16. The oscillating, floor treating device of claim 10, wherein the floor treating attachment is further configured to connect to the counterbalance at at least two different distances from the axis of rotation of the drive shaft.

17. The oscillating, floor treating device of claim 16, wherein the floor treating attachment is configured to connect at the first distance of about 0.4375 inch from the axis of rotation of the drive shaft and at a second distance of about 0.5625 inch from the axis of rotation of the drive shaft.

18. The oscillating, floor treating device of claim 10, wherein the power source provides at least 0.75 horsepower.

19. The oscillating, floor treating device of claim 10, wherein the first distance is between about 0.4 inch and about 0.6 inch from the axis of rotation of the drive shaft.

20. The oscillating, floor treating device of claim 10, wherein a user can utilize the oscillating, floor treating device while the user is standing.

* * * * *